US006530507B2

(12) United States Patent
Oh

(10) Patent No.: US 6,530,507 B2
(45) Date of Patent: Mar. 11, 2003

(54) CONVERTIBLE BACKPACK

(75) Inventor: Scott Oh, Carson, CA (US)

(73) Assignee: Luggage America, Inc., Carson, CA (US)

( * ) Notice: Subject to any disclaimer, the term of this patent is extended or adjusted under 35 U.S.C. 154(b) by 0 days.

(21) Appl. No.: 09/909,703

(22) Filed: Jul. 19, 2001

(65) Prior Publication Data

US 2003/0015559 A1 Jan. 23, 2003

(51) Int. Cl.[7] ..... A45F 4/02

(52) U.S. Cl. ..... 224/153; 224/579; 224/627; 224/653; 190/18 A

(58) Field of Search ..... 224/153, 575, 224/576, 577, 578–583, 627, 628, 633, 642, 644, 645, 650, 652, 653, 654, 655, 657; 190/18 A, 18 R, 111

(56) References Cited

U.S. PATENT DOCUMENTS

D387,198 S * 12/1997 Lehmann et al. ..... 224/153
5,749,503 A 5/1998 Wulf et al. ..... 224/153
5,893,495 A * 4/1999 Godshaw et al. ..... 190/115
5,984,154 A * 11/1999 Scicluna ..... 190/18 A
6,095,385 A * 8/2000 Utu et al. ..... 190/18 A
6,129,254 A * 10/2000 Yu ..... 190/110
6,279,706 B1 * 8/2001 Mao ..... 16/113.1
6,305,587 B1 * 10/2001 Miller ..... 224/153

* cited by examiner

*Primary Examiner*—Stephen K. Cronin
(74) *Attorney, Agent, or Firm*—Lee & Hong; Jonathan Y. Kang

(57) ABSTRACT

An improved convertible luggage which conveniently converts from a wheeled suitcase to a backpack having a first and second compartment, wherein the second compartment encloses a pair of shoulder straps having two ends wherein both ends of the shoulder straps are affixed within the second compartment. The straps can be deployed by opening the cover of the second compartment, and when the second compartment is closed, the straps are completely enclosed within the second compartment. In addition, the cover of the second compartment is designed to be folded and affixed to the bottom of the convertible luggage such that a double layer of cushion is provided between the user and the wheels of the luggage while the luggage is in the backpack mode.

11 Claims, 4 Drawing Sheets

CONVERTIBLE BACKPACK

BACKGROUND OF THE INVENTION

1. Field of the Invention

The present invention relates to generally to luggage containers. More specifically, to convertible luggage that can be used as a wheeled suitcase and backpack.

2. Discussion of the Related Art

A challenge to traveling has always been carrying one's belongings in the most efficient and easy manner. However, depending on the circumstances, one bag, is often not the best for all situations. Depending on pavement conditions, the number of stairs, etc., a backpack can be best fitted for the situation. At other times, a wheeled suitcase is best to transport heavier baggage through airports, even roads, etc. The problem arises when a traveler is confronted with more than one type of terrain during a single trip or the traveler is preparing to travel to an unknown destination. To meet this challenge, convertible luggage designs have appeared in the prior art to convert from a wheeled suitcase to a backpack, and vice versa. However, prior art designs have always had the problem with locating the straps for the backpack, so as to not interfere with the wheeled suitcase, and at the same time create a way for the wheels to not interfere with the user while wearing the suitcase as a backpack (i.e. wheels rubbing against the back of the wearer of the backpack). Although various attempts have been made to solve the problem, as popularity of convertible suitcases become increasingly more popular, an improved design is needed.

SUMMARY OF THE INVENTION

Accordingly, the present invention is directed to an improved luggage apparatus that substantially obviates one or more of the problems due to limitations and disadvantages of the related art. The preferred embodiments provide a convertible luggage container capable of being in a backpack mode or a wheeled suitcase mode comprising: a first compartment; a pair of wheels mounted to the first compartment; a second compartment affixed to the first compartment; a cover defining and providing access to the second compartment; a pair of shoulder straps having two ends wherein the ends are affixed within the second compartment; such that the straps can be deployed by opening the second compartment, and when the second compartment is closed, the straps are completely enclosed within the second compartment.

According to one aspect of the present invention, the cover is defined by a front side, a back side, a top edge, a bottom edge and a center, wherein the cover further comprises a first fastener attached near the center of the back side. The first fastener is exposed by opening and folding the cover in the center along the front side. In preferred embodiments, the folded cover is wrapped over the bottom edge covering the pair of wheels and removably affixed to the first compartment when in the convertible luggage is in the backpack mode. Still further, the wheels are cushioned by a double thickness of the cover since the cover is folded in the center and removably affixed by the first fastener.

According to another aspect of the present invention, the convertible luggage further comprises a flap attached above the second compartment; a zipper used to open and close the cover from the second compartment; and a second fastener located at the top edge of the cover to removably affix the cover to the flap in the wheeled suitcase mode such that the flap will hide the zipper when the cover is closed.

Advantages of the present invention over the prior art include the ability to eliminate unnecessary strap buckles along the outside of the luggage. By completely enclosing the shoulder straps within the second compartment, the luggage can be better used in tight spaces and other situations where the buckles may get entangled or exposed to damage (e.g. baggage claim at an airport.) In addition, by providing a double layer of cushion between the user and the wheels of the luggage, additional comfort can be given to the wearer of the luggage in the backpack mode. Moreover, by providing an additional cover for the zippers in the wheeled suitcase mode, the zippers are tucked out of the way from being damaged or caught on other bags or tight doorways.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Hereinafter, the present invention will be described with respect to the preferred embodiment illustrated in the annexed drawings.

Figure 1:
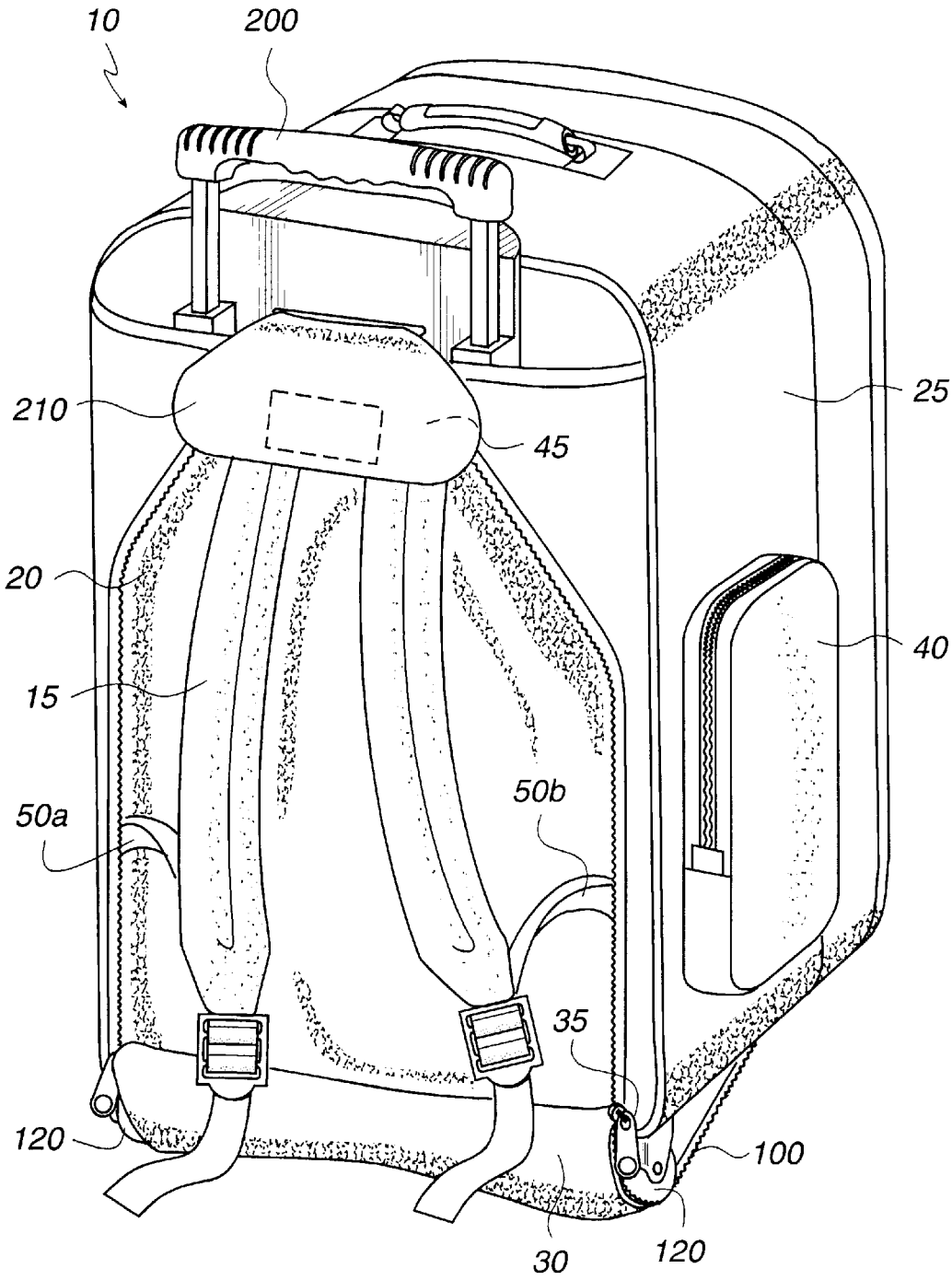
FIG. 1 is a perspective view of the convertible luggage in the backpack configuration in accordance with the preferred embodiments of the present invention.

FIG. 1 is a perspective view of the convertible luggage in the backpack configuration in accordance with the preferred embodiments of the present invention. As shown in FIG. 1, the luggage 10 can be fully converted into a backpack with a pair of straps 15 which can be worn over the user's shoulders such that the back side of the luggage is carried snug across the user's back. The luggage 10 can be formed of any convenient durable material, such as canvas, fabric, nylon, leather, plastic (e.g. vinyl), etc. As in other prior art convertible luggage designs, the luggage has an extendable handle and wheels which are attached to the mainframe of the luggage.

The luggage 10 has two compartments 20, 25 wherein the main compartment 25 is used to keep the user's belongings, while a second compartment 20 is used to maintain a pair of shoulder straps 15 while in the luggage 10 is in the wheeled suitcase mode. In addition, in preferred embodiments, a side compartment 40 is also attached to the main compartment 25, which can used to store additional items for the user.

As seen in FIG. 1, the second compartment 20 is affixed to the backside of the main compartment 25. A zipper 100 is used to open and close three sides of the second compartment 20 and generally defines the shape of the second compartment 20. When the second compartment 20 is fully opened, the second compartment cover 30 is permanently attached to the bottom edge 35 of the luggage 10, and can be folded over the wheels 120, as will be discussed in greater detail with respect to FIGS. 3 and 4. Also seen in FIG. 1, a pair of shoulder straps 15 are positioned in the second compartment 20. The shoulder straps 15 are standard cushioned shoulder pads used with existing backpacks and well known in the art. Before the second compartment cover 30 is opened, the straps 15 are concealed by the cover 30. When the second compartment cover 30 is opened, the straps 15 are exposed and deployed from the second compartment 20. At one of the shoulder straps ends, they are affixed to the second compartment at a position close to the top edge 45. In addition, a key improvement over prior art designs is that the luggage 10 has the second ends of the straps 15 sown directly within the second compartment 20 at points 50*a* and *b*. Therefore, the straps are fully encased within the second compartment 20 when the zipper 100 is used to close the second compartment 20 (best seen in FIG. 2). Thus, there is no need to attach straps 15 to outside buckles as in other prior art designs, where outside buckles can be both aesthetically unpleasing and also interfere with the use of the luggage as a wheeled suitcase (e.g. can get caught in doorways or tight spaces, etc.). Moreover, by keeping straps 15 completely within the second compartment 20, a side compartment 40 can be attached to the main compartment 25 without interference from any buckles or other fastening means on the outside of the main compartment 25.

Figure 2:
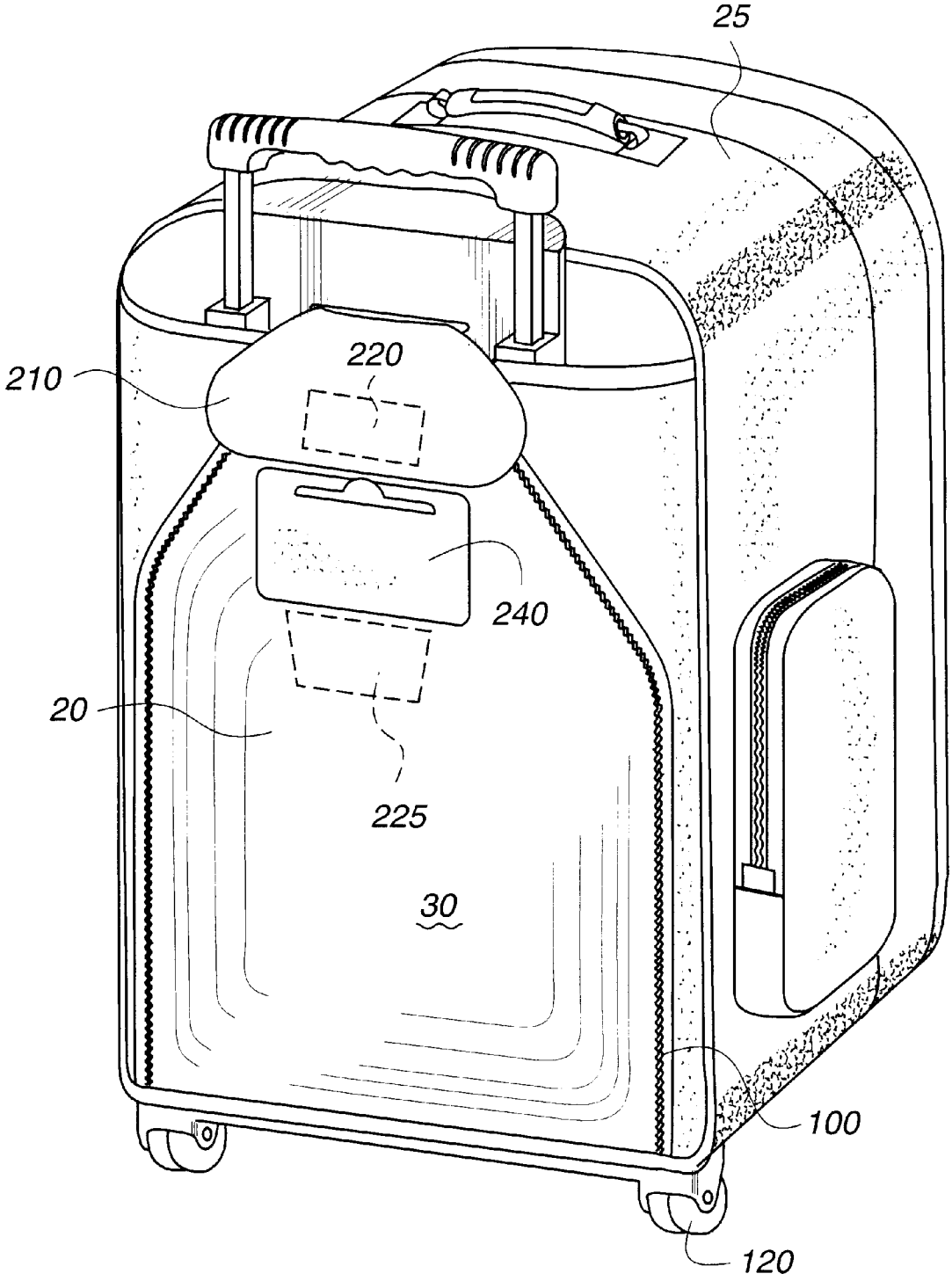
FIG. 2 is a perspective view of the convertible luggage in the wheeled suitcase configuration in accordance with the preferred embodiments of the present invention.

FIG. 2 is a perspective view of the convertible luggage 10 in the wheeled suitcase configuration in accordance with the preferred embodiments of the present invention. As seen in FIG. 2, the second compartment 20 is closed, hiding and protecting the straps 15 during the times the luggage is wheeled. The extendable handle 200 is mounted on the first compartment 25 at a position that is adjacent to the backside of the first compartment 25. In the wheeled suitcase configuration, the handle 25 extends out of the top of the first compartment 25 to a predetermined distance and used by the user to pull the luggage by rolling the wheels 120 after tilting the luggage 10. Hidden from direct view, but shown in outline form in FIG. 2 are Velcro fasteners 220 and 225. Velcro fastener 220 is used to close flap 210 over the closed second compartment cover 30. In the preferred embodiment the flap 210 is used to cover the handles of the zipper 100 in the wheeled suitcase configuration to hide and protect the handles of the zipper 100, providing both aesthetic and utilitarian benefits. Velcro fastener 225 will be discussed in greater detail with FIGS. 3 and 4. In addition, in preferred embodiments, a name card holder 240 is attached to the back of the second compartment 20. By providing a name card holder 240 in the back of the second compartment 20, the name card does not interfere with other compartments 25, 40, especially since other users often place other bags on top of the luggage 10 and use the wheeled suitcase to carry both the luggage 10 and the additional bag whose straps can be wrapped around the extendable handle 200.

Figure 3:
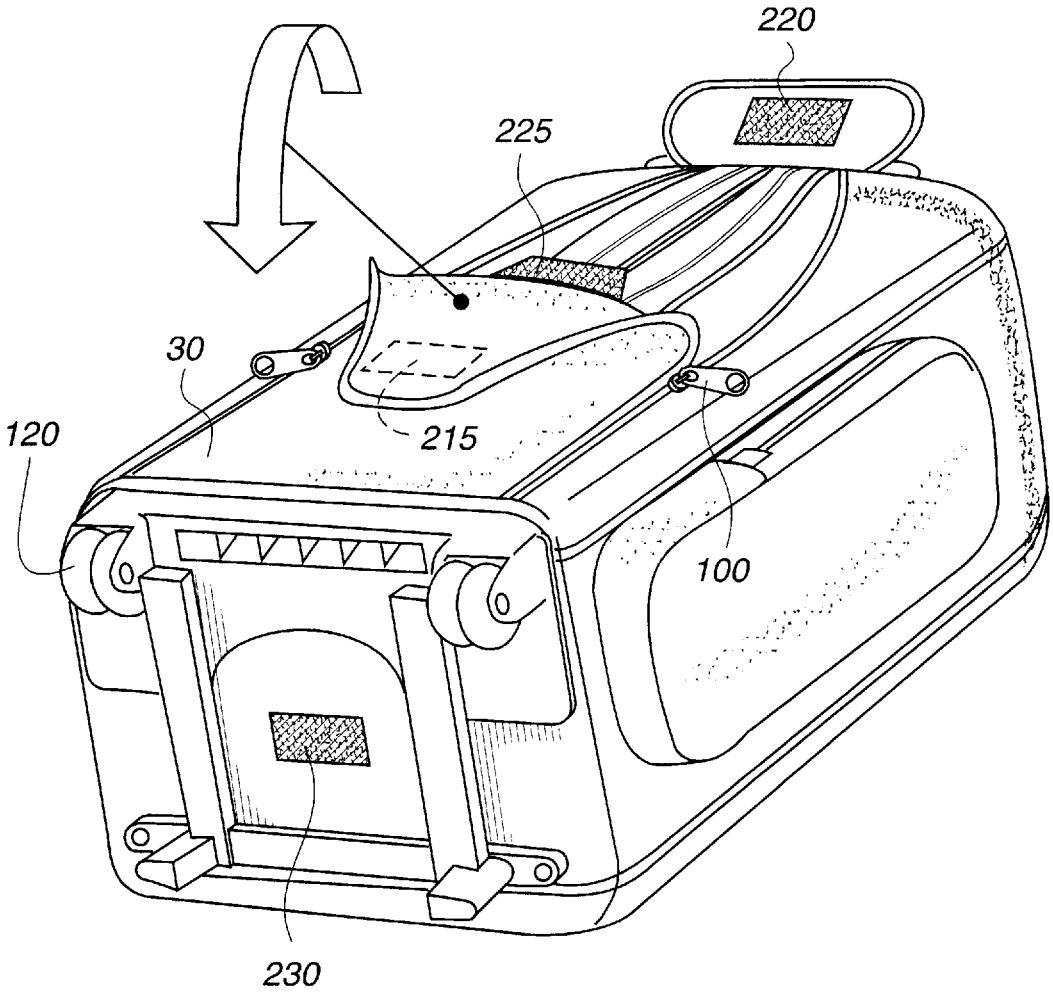
FIG. 3 is a view illustrating the conversion of the wheeled suitcase into the backpack configuration in accordance with the preferred embodiments of the present invention.
Figure 4A:
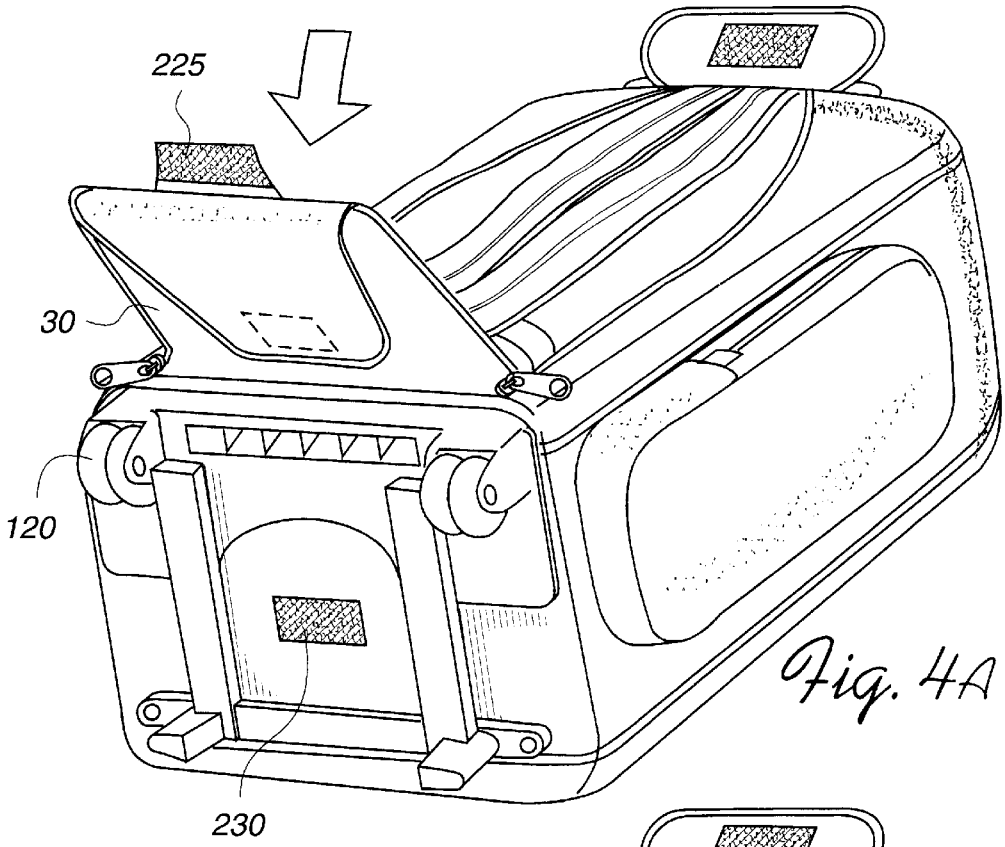
FIGS. 4A and 4B are further views illustrating the conversion of the wheeled suitcase into the backpack configuration in accordance with the preferred embodiments of the present invention.
Figure 4B:
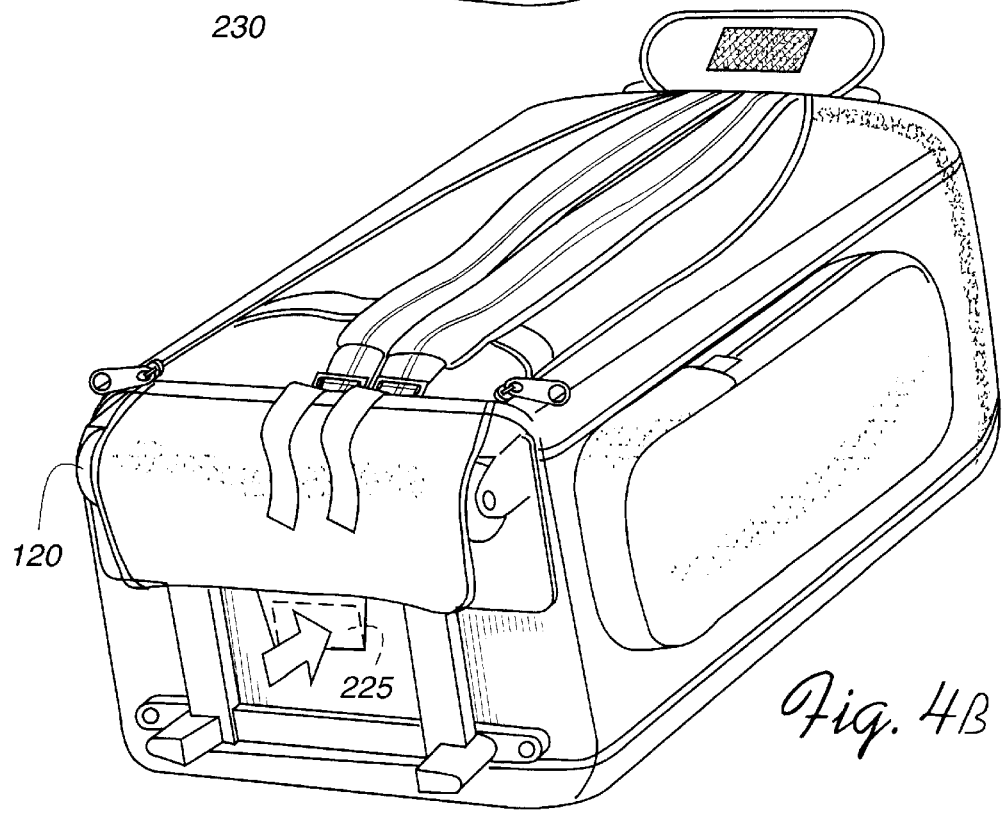

FIGS. 3 and 4A and 4B are views illustrating the conversion of the wheeled suitcase into the backpack configuration in accordance with the preferred embodiments of the present invention. As seen in FIG. 3, the second compartment cover 30 can be opened by undoing the zipper 100 and releasing the cover 30 from the Velcro fastener 220. The side with other end 215 of the Velcro fastener 220 is then folded in half. Upon folding the cover 30, Velcro fastener 225 is revealed. The cover 30 is then folded over the wheels 100 as seen in FIG. 4A and 4B. Thus, the outer side of the cover 30 is wrapped around the portion of the wheels, which face the back side of the luggage, and Velcro fastener 225 is secured to the other end 230 of the Velcro fastener 225 located on the bottom of the luggage 10. In this manner, the wheels 100 are covered to eliminate any discomfort for the user while the user wears the luggage 10 in the backpack mode. Moreover, because the cover 30 is folded in half before being wrapped around the wheels 120, the wheels 120 are covered by twice the thickness of the cover 30. Thus, as the luggage 10 is used as a backpack, additional comfort for the user is provided against the wheels 120. This is especially true given, that in preferred embodiments, the cover 30 is padded providing additional comfort for the user of the luggage 10. In addition, by covering the wheels 120, the user's back, clothing and belongings are protected from debris accumulated on the wheels 120 while the wheels 120 are rolled along an unclean surface. According to the preferred embodiment of the present invention, the wheels 120 are dual wheels (two wheels on each side) to provide stability and easy transport.

Those skilled in the art will appreciate that alternative embodiments exists from the description of the preferred embodiments without departing from the spirit and scope of the invention. Preferred embodiments were shown in the context of a standard carry-on size luggage. However, in alternative embodiments, a full size luggage or a luggage with additional compartments can be substituted for the preferred luggage. For example, a third compartment can be affixed to the front side of the first compartment, where the third compartment is optionally removable as a day pack. In addition, although the convertible luggage was described as being convertible from a wheeled suitcase to a backpack, the convertible luggage can always be carried by hand using handles attached to the luggage or carrying the luggage by the shoulder straps rather than wearing the luggage on the user's back.

In the described embodiments, the fasteners were described as Velcro fasteners. In alternative embodiments, any fastener can be used including buttons, additional zippers, snaps or the like. In addition, the shoulder straps can take any known mechanism allowing the user to hold the luggage on the user's back. For example, the shoulder straps can comprise a single strap to place over one shoulder and body of the user while the user wears the luggage in the backpack mode. Moreover, although the preferred embodiments were described as having a cushioned straps and cushioned cover, the entire second compartment can be made from a cushioned material known in the art (e.g. styrofoam) to better cushion the back of the user while wearing luggage as a backpack.

Therefore, the foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. A convertible luggage container capable of being in a backpack mode or a wheeled suitcase mode comprising:

a first compartment;

a pair of wheels mounted to the first compartment;

a second compartment affixed to the first compartment;

a cover defining and providing access to the second compartment; and a pair of shoulder straps having two ends wherein the ends are affixed within the second compartment, such that the straps can be deployed by opening the second compartment, and when the second compartment is closed, the straps are completely enclosed within the second compartment, wherein the cover is defined by a front side, a back side, a top edge, a bottom edge and a center, wherein the cover further comprises a first fastener attached near the center of the back side.

2. The convertible luggage of claim 1, further comprising:

a flap attached above the second compartment;

a zipper used to open and close the cover from the second compartment; and a second fastener located at the top edge of the cover used to removably affix the cover to the flap in the wheeled suitcase mode such that the flap will hide the zipper when the cover is closed.

3. The convertible luggage of claim 1, further comprising:

a third compartment affixed to the first compartment perpendicular to the second compartment.

4. The convertible luggage of claim 1, wherein the cover further comprises a name tag holder affixed to the front side of the cover.

5. The convertible luggage of claim 1, wherein the first fastener is exposed by opening and folding the cover in the center along the front side.

6. The convertible luggage of claim 5, wherein the cover is removably affixed to the first compartment when the folded cover is wrapped over the bottom edge covering the pair of wheels in the backpack mode.

7. The convertible luggage of claim 6, herein the wheels are cushioned by a double thickness of the cover since the cover is folded in the center and removably affixed to the first compartment using the first fastener.

8. A convertible luggage container capable of being in a backpack mode or a wheeled suitcase mode comprising:

a first compartment;

a pair of wheels mounted to the first compartment;

a second compartment affixed to the first compartment;

a cover defining and providing access to the second compartment;

a pair of shoulder straps having two ends wherein the ends are affixed within the second compartment, such that the straps can be deployed by opening the second compartment, and when the second compartment is closed, the straps are completely enclosed within the second compartment, wherein the cover is defined by a front side, and a back side, and wherein the cover further comprises a first fastener attached to the back side.

9. The convertible luggage of claim 8, wherein the first fastener is exposed by opening and folding the cover along the front side.

10. The convertible luggage of claim 9, wherein the cover is removably affixed to the first compartment when the folded cover is wrapped over the bottom edge covering the pair of wheels in the backpack mode.

11. A convertible luggage container capable of being in a backpack mode or a wheeled suitcase mode comprising:

a first compartment;

a pair of wheels mounted to the first compartment;

a second compartment affixed to the first compartment;

a cover defining and providing access to the second compartment;

a pair of shoulder straps having two ends wherein the ends are affixed within the second compartment, such that the straps can be deployed by opening the second compartment, and when the second compartment is closed, the straps are completely enclosed within the second compartment, wherein the cover is defined by a front side, a back side, a top edge, a bottom edge and a center, wherein the cover further comprises a first fastener attached approximately near the top edge of the front side, such that when the cover is folded over the wheels, the top edge can be removably affixed to the first compartment using the first fastener.

* * * * *